US009297201B1

(12) United States Patent
Melnick

(10) Patent No.: US 9,297,201 B1
(45) Date of Patent: Mar. 29, 2016

(54) PRIVACY BARRIER FOR BALCONY

(71) Applicant: Ron Melnick, Agassiz (CA)

(72) Inventor: Ron Melnick, Agassiz (CA)

( * ) Notice: Subject to any disclaimer, the term of this patent is extended or adjusted under 35 U.S.C. 154(b) by 0 days.

(21) Appl. No.: 14/572,051

(22) Filed: Dec. 16, 2014

(51) Int. Cl.

| | |
|---|---|
| ***E05D 15/06*** | (2006.01) |
| ***E06B 9/24*** | (2006.01) |
| ***E06B 11/02*** | (2006.01) |
| ***E06B 11/04*** | (2006.01) |
| ***E05B 65/00*** | (2006.01) |

(52) U.S. Cl.
CPC ..... *E06B 9/24* (2013.01); *E05B 65/0007* (2013.01); *E06B 11/026* (2013.01); *E06B 11/045* (2013.01)

(58) Field of Classification Search
CPC ..... E06B 9/24; E06B 11/045; E06B 11/026; E05B 65/0007
USPC ..... 49/404, 323; 256/73; 52/28, 64, 207, 73
See application file for complete search history.

(56) References Cited

U.S. PATENT DOCUMENTS

| | | | | | |
|---|---|---|---|---|---|
| 69,024 | A | * | 9/1867 | Reynolds | 49/427 |
| 118,393 | A | * | 8/1871 | Root | 49/427 |
| 179,617 | A | * | 7/1876 | Shugart | 49/450 |
| 337,597 | A | * | 3/1886 | Lightfoot | 49/427 |
| 403,694 | A | * | 5/1889 | Norlin | 49/289 |
| 556,171 | A | * | 3/1896 | Anderson | 49/427 |
| 575,229 | A | * | 1/1897 | Garrard | 49/427 |
| 601,257 | A | * | 3/1898 | Jenkins | 49/409 |
| 731,716 | A | * | 6/1903 | Slater | 49/427 |
| 761,922 | A | * | 6/1904 | Shivel | 49/427 |
| 800,047 | A | * | 9/1905 | Appling | 49/427 |
| 1,025,725 | A | * | 5/1912 | Tothill | 49/427 |
| 1,277,844 | A | * | 9/1918 | Browne | 49/427 |
| 1,364,934 | A | * | 1/1921 | Johnson | 49/425 |
| 5,272,839 | A | | 12/1993 | Karhu | |
| 5,579,608 | A | * | 12/1996 | Dunn | 49/404 |
| 5,596,842 | A | | 1/1997 | Sjoholm | |
| 5,749,172 | A | | 5/1998 | Isopahkala | |
| 5,873,205 | A | * | 2/1999 | Hanlon et al. | 52/239 |
| 6,089,302 | A | | 7/2000 | Britt | |
| 6,435,250 | B1 | | 8/2002 | Pichik et al. | |
| 6,575,435 | B1 | | 6/2003 | Kotzen | |
| 7,082,981 | B2 | | 8/2006 | Perez, Jr. | |
| 7,219,709 | B1 | | 5/2007 | Williams | |
| 8,240,088 | B2 | * | 8/2012 | Tarrega Lloret | 49/404 |
| 8,267,380 | B1 | | 9/2012 | Dormeville | |
| 8,297,334 | B2 | | 10/2012 | Chu | |
| 8,419,107 | B2 | | 4/2013 | Manchanda | |
| 2004/0003556 | A1 | * | 1/2004 | Zerbst | 52/220.7 |

(Continued)

FOREIGN PATENT DOCUMENTS

| | | |
|---|---|---|
| EP | 0576799 A1 | 1/1994 |
| EP | 1273749 A2 | 1/2003 |

(Continued)

OTHER PUBLICATIONS http://www.lumenhaus.com/design/drawings/ (Nov. 12, 2010).

*Primary Examiner* — Jerry Redman
(74) *Attorney, Agent, or Firm* — Robert C. Montgomery; Montgomery Patent & Design LP.

(57) ABSTRACT

A privacy barrier apparatus for a balcony includes a slide column configured to be connected to and supported by a structure. The apparatus includes a barrier assembly slidably connected to the slide column. The barrier assembly is linearly movably relative to the slide column between a retracted position and an extended position.

8 Claims, 5 Drawing Sheets

(56) References Cited

U.S. PATENT DOCUMENTS

| | | | | |
|---|---|---|---|---|
| 2006/0107596 | A1 * | 5/2006 | Ohata | 49/73.1 |
| 2010/0024307 | A1 * | 2/2010 | Dale et al. | 49/360 |
| 2011/0113694 | A1 * | 5/2011 | Douche et al. | 49/425 |
| 2012/0292941 | A1 | 11/2012 | Bills | |
| 2013/0008089 | A1 | 1/2013 | MAncebo | |

FOREIGN PATENT DOCUMENTS

| | | | | |
|---|---|---|---|---|
| EP | 1532339 | | 5/2005 | |
| FR | 2422019 | * | 2/1979 | |
| JP | 06248832 A | * | 9/1994 | E04H 17/16 |
| WO | WO 9013725 A1 | * | 11/1990 | E06B 3/46 |

* cited by examiner

PRIVACY BARRIER FOR BALCONY

RELATED APPLICATIONS

Not applicable.

FIELD OF THE INVENTION

The present invention relates generally to balconies and, more particularly, to an extendable privacy barrier for a balcony.

BACKGROUND OF THE INVENTION

Many housing units such as apartments, hotels, condominiums, townhouses, and the like have balcony areas that are immediately adjacent to other nearby units. Such balconies not only offer a great view of the surrounding neighborhood, an increase in living space, and a connection to the outdoor world, but they offer a great place to congregate with others.

Unfortunately, their proximity to other balconies, with only a railing separating them in some cases, means that privacy is non-existent. Users may find themselves literally standing inches from a neighbor who may be using their balcony at the same time. Even if the neighbor is not outside, a direct view in and out of their window or door is possible. While permanent partitions can be built, they will greatly reduce visibility for inside occupants, thus resulting in an effect of "tunnel vision".

Accordingly, there exists a need for a means by which adjacent balconies on housing units can be provided with privacy as needed in order to address the problems as described above.

SUMMARY OF THE INVENTION

The inventor has recognized the aforementioned inherent problems and lack in the art and observed that there is a need for a privacy shade for a balcony. The development of the present invention, which will be described in greater detail herein, substantially departs from conventional solutions to fulfill this need.

In one (1) embodiment, the disclosed privacy barrier apparatus for a balcony includes a slide column configured to be connected to and supported by a structure. The apparatus includes a barrier assembly slidably connected to the slide column. The barrier assembly is linearly movably relative to the slide column between a retracted position and an extended position.

In another embodiment, the disclosed privacy barrier apparatus for a balcony includes a slide column configured to be connected to and supported by a vertical structure. The slide column includes a hollow body including an open first end and an opposed open second end, a channel extending through the body, the channel extending from the first end to the second end, a first roller disposed within the channel at the first end, a second roller disposed within the channel at the second end, and a locking mechanism disposed at least one (1) of the first end and the second end. The apparatus includes a barrier assembly slidably connected within the channel of the slide column. The barrier assembly includes an exterior framework including a top, a bottom opposite said top, a first side, and a second side opposite said first side defining an interior, a panel connected within the interior of the framework, a first handle connected to the first side of the framework, and a second handle connected to the second side of the framework. The barrier assembly is linearly movable through the channel to a plurality of linear positions relative to the slide column between a fully retracted position and a fully extended position. The first roller engages the top of the framework when the barrier assembly is linearly moved within the channel. The second roller engages the bottom of the framework when the barrier assembly is linearly moved within the channel. The locking mechanism engages the framework for locking the barrier assembly at a selected linear position of the plurality of linear positions. The first handle limits linear movement of the barrier assembly to the fully extended position. The second handle limits linear movement of the barrier assembly to the fully retracted position.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
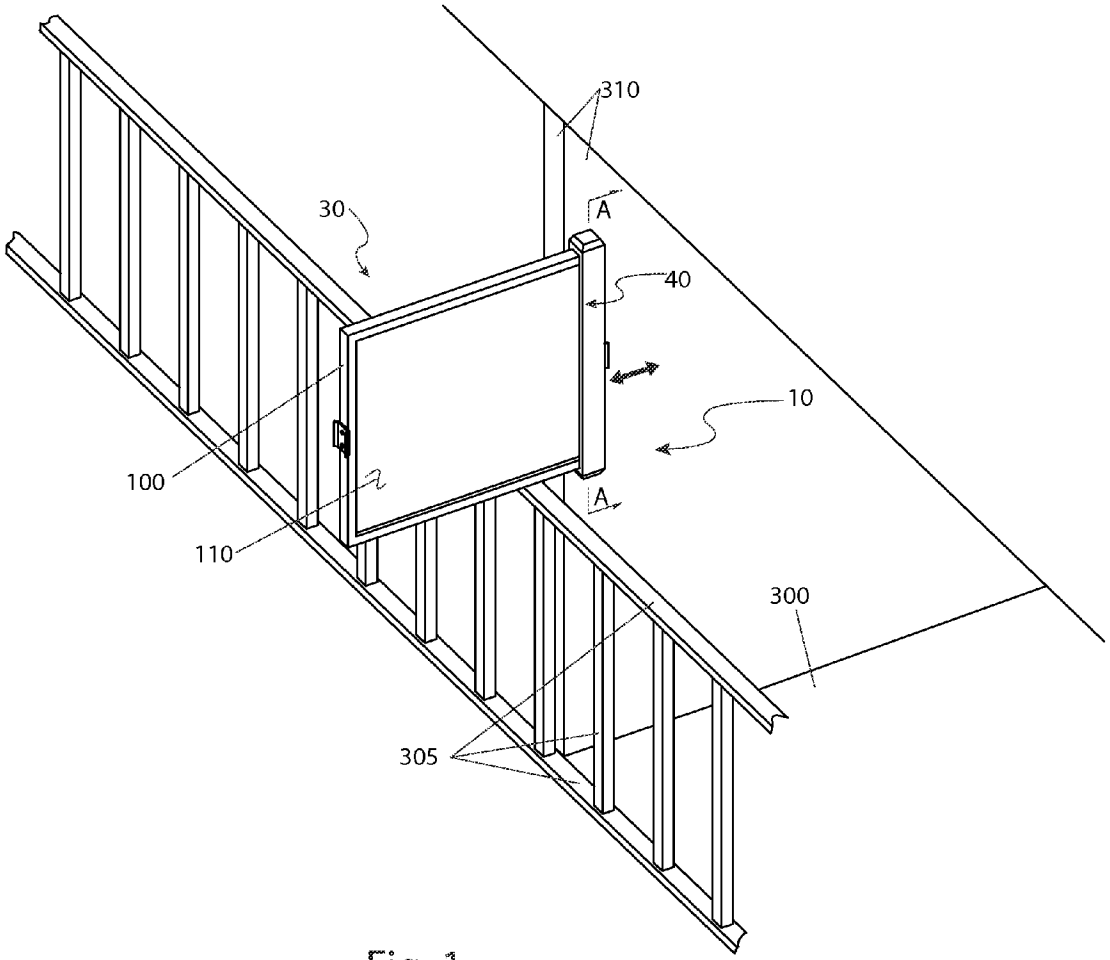
FIG. 1 is an environmental view of one embodiment of the disclosed privacy barrier for a balcony.

10 privacy barrier
30 barrier assembly
40 slide column
50 extension column
60 channel
70 aperture
80 cap
90 inserting feature
100 framework
110 panel
120 handle
130 locking mechanism
140 pin
141 lock bolt/knob
180 detent
210 roller
300 balcony
305 railing
310 wall structure

DETAILED DESCRIPTION OF THE PREFERRED EMBODIMENT

In accordance with the invention, the best mode is presented in terms of a one (1) or more of the disclosed embodiments, herein depicted within FIGS. 1 through 4. However, the disclosure is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

As used herein, the terms "first", "second", "third", etc. are used as labels to describe various elements, features, and/or components, and are not intended to impose ordinal, positional, or hierarchical requirements on the referenced items, unless other indicated. For example, such terms may be used to distinguish one (1) element from another element.

As used herein, relative terms such as "front", "rear", "left", "right", "top", "bottom", "below", "above", "upper", "lower", "horizontal", or "vertical" are used to describe a relationship of one (1) element, feature and/or region to another element, feature and/or region as illustrated in the figures.

Referring to FIGS. 1-4, disclosing a privacy barrier for a balcony (herein described as the "apparatus") 10, where like reference numerals represent similar or like parts. The apparatus 10 includes a slide column 40 that supports a barrier assembly 30 that is extended and retracted to provide a desired level of privacy, for example to a balcony area.

Referring to FIG. 1, the apparatus 10 is illustrated being affixed to a wall structure 310 being adjacent to an outdoor balcony, thereby providing visual privacy; however, it is understood that the apparatus 10 is not limited to the illustrated application and may be mounted to various structures and/or railings 305 to provide a visual barrier between tenants, and as such should not be interpreted as a limiting factor.

In the event a person or multiple people occupy the balcony 300 and desire a greater level of privacy, the barrier assembly 30 of the apparatus 10 extends outward, for example, approximately twenty inches (20 in.), from the slide column 40 and is locked in place. The apparatus 10 is envisioned being removably attached to the railing 305 using clamps, brackets, and/or fasteners, which correspond to features of the wall structure 310 and/or railing 305.

A pair of apparatuses 10 is envisioned being used in the case of adjacent tenants on each side of the balcony 300. The apparatus 10 is envisioned to be introduced having barrier assemblies 30 in various widths and heights to suit various installations and a desired degree of privacy desired. The apparatus 10 is envisioned to be introduced in coordinated colors to match or contrast other building features such as trim color, wall color, railings, window trim, or the like.

Figure 2B:
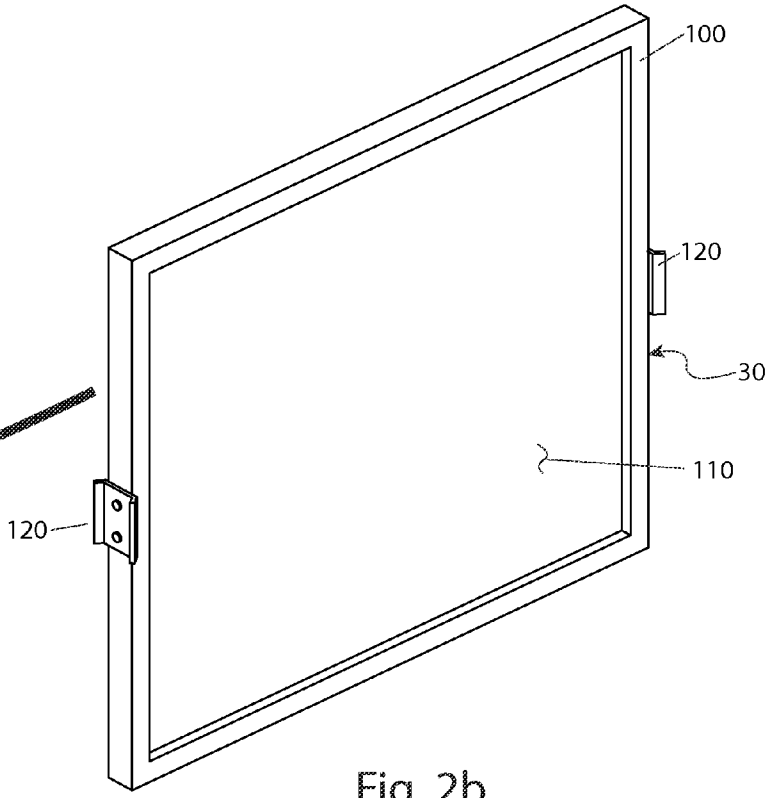
FIG. 2*b* is a perspective view of the barrier assembly of the privacy barrier.
Figure 2A:
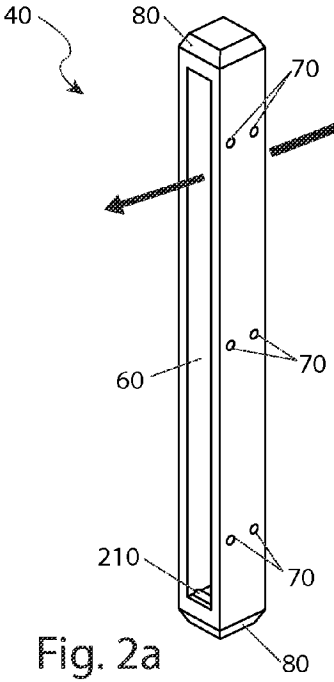
FIG. 2*a* is a perspective view of the slide column of the privacy barrier.
Figure 2C:
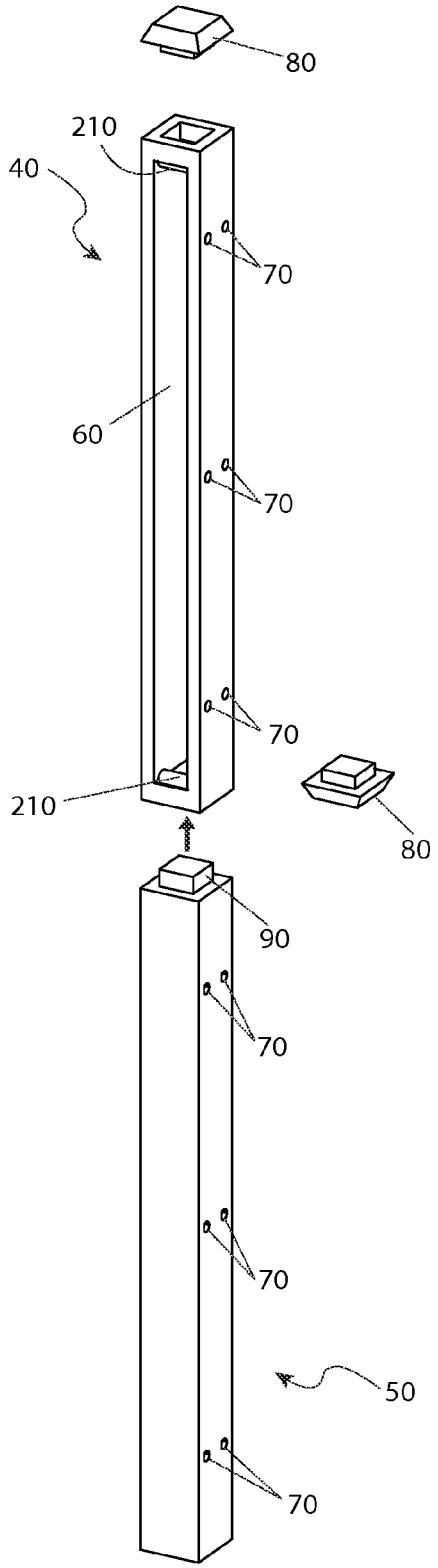
FIG. 2*c* is an exploded view of the slide column and the extension column of the privacy barrier.

Referring to FIGS. 2*a*, 2*b*, and 2*c*, the slide column 40 includes a central longitudinal channel 60 extending therethrough, being sized for snug insertion of the barrier assembly 30, which may be selectively extended. The slide column 40 is envisioned to be stationarily attached to a portion of the balcony 300 such as, but not limited to, a wall structure 310, a railing 305, and/or other structural features. The barrier assembly 30 is slidably extended or retracted through the channel 60 of the slide column 40 to provide a desired level of privacy.

The apparatus 10 provides a means of being extended via inserted connection of an extension column 50 to an end of the slide column 40. The slide column 40 supports the barrier assembly 30, whereas the extension column 50 acts to extend a length of the slide column 40 in a linear manner to enable subjacent attachment to the railing 305 or other structural feature of the balcony 300.

The channel 60 of the slide column 40 provides a vertical height suitable to slidably receive and support the barrier assembly 30, enabling movement of the barrier assembly 30 from a retracted position to an extended position. The slide column 40 is also provided with a plurality of apertures 70 along side surfaces, through which fasteners may be inserted, to mount the slide column 40 to a wall structure 310 or similar portion of the balcony 300.

The slide column 40 is preferably attached using lag bolts; however, it is understood that other fasteners may be utilized without deviating from the teachings of the present disclosure, and as such should not be interpreted as a limiting factor.

Each distal end of the slide column 40 is provided with a decorative cap 80 to cover, conceal, and protect internal portions of the hollow slide column 40. The caps 80 are removable and preferably attach to each opposing end of the slide column 40 using an interference fit or may utilize fasteners (e.g., screws) if desired. The hollow slide column 40 is sized and shaped to slidably receive an inserting feature 90 being integrally-molded along an end of the extension column 50.

The extension column 50 includes an elongated rigid structure, complimenting the cross-section profile of the slide column 40. The inserting feature 90 includes a stepped-down-shape to enable it to be slidably inserted into either end of the slide column 40 upon removal of a respective cap 80.

It is envisioned that a user may attach the slide column 40 to the extension column 50 to provide additional rigidity using at least one (1) fastener, if desired.

The extension column 50 acts as an extension of the slide column 40, thereby enabling attachment of the apparatus 10 to the railing 305 of the balcony 300 via additional apertures 70 of the extension column 50 and is envisioned being mounted using straight or "L"-shaped brackets and fasteners (not shown), as required. However, it is understood that other methods to mount the apparatus 10 may be utilized without deviating from the teachings of the present disclosure and as such should not be interpreted as a limiting factor.

The barrier assembly 30 includes a framework 100 encompassing and securing a panel 110 therewithin. The framework 100 includes a parallelogram shape being suitably sized so as to be slidably inserted into and capable of traversing the channel 60. The panel 110 includes a planar member exhibiting optical properties that provide a translucent or an opaque barrier such as, but not limited to, frosted glass, fiberglass, plastic, sheet metal, or the like.

Opposing forward-facing and rearward-facing surfaces of the framework 100 include respective handles 120. The handles 120 preferably include "U"-shaped appendages having outwardly angled side portions or an equivalent ergonomic form to facilitate easy horizontal manipulation of the barrier assembly 30 within the channel 60. The handles 120 further provide a mechanical limitation by abutting against the slide column 40 when fully extended or retracted. The handles 120 are envisioned to be affixed to the framework 100 using fasteners such as screws or the like.

Figure 3:
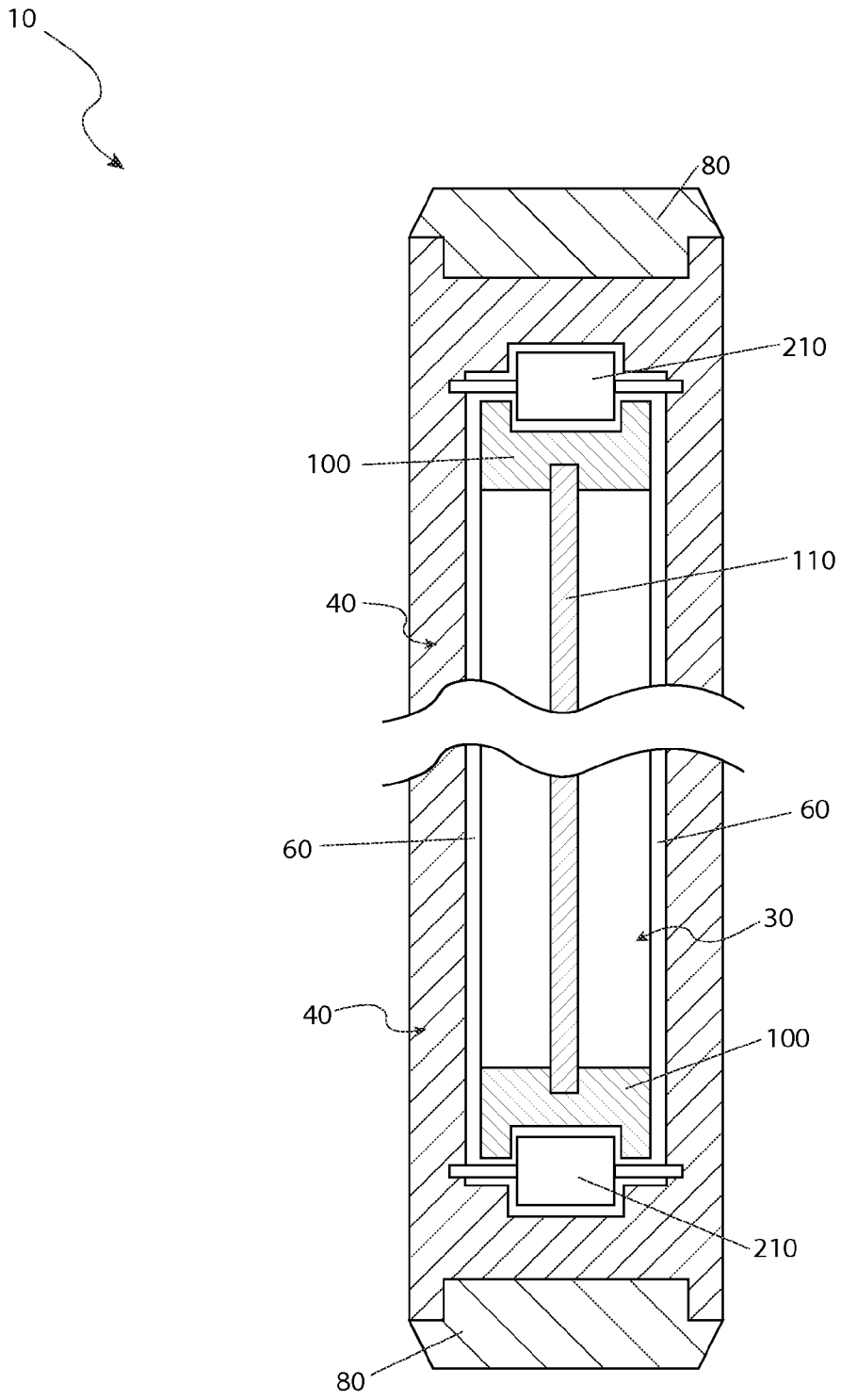
FIG. 3 is a sectional view of the privacy barrier taken along section line A-A of FIG. 1; and, FIG. 4 is a partial perspective view of the locking mechanism of the privacy barrier.

Referring to FIG. 3, the slide column 40 includes a plurality of axial rollers 210 along top and bottom surfaces of the channel 60 that bear upon top and bottom surfaces of the framework 100 of the barrier assembly 30 to provide smooth and scratch-free motioning of the barrier assembly 30 within the channel 60.

Figure 4:
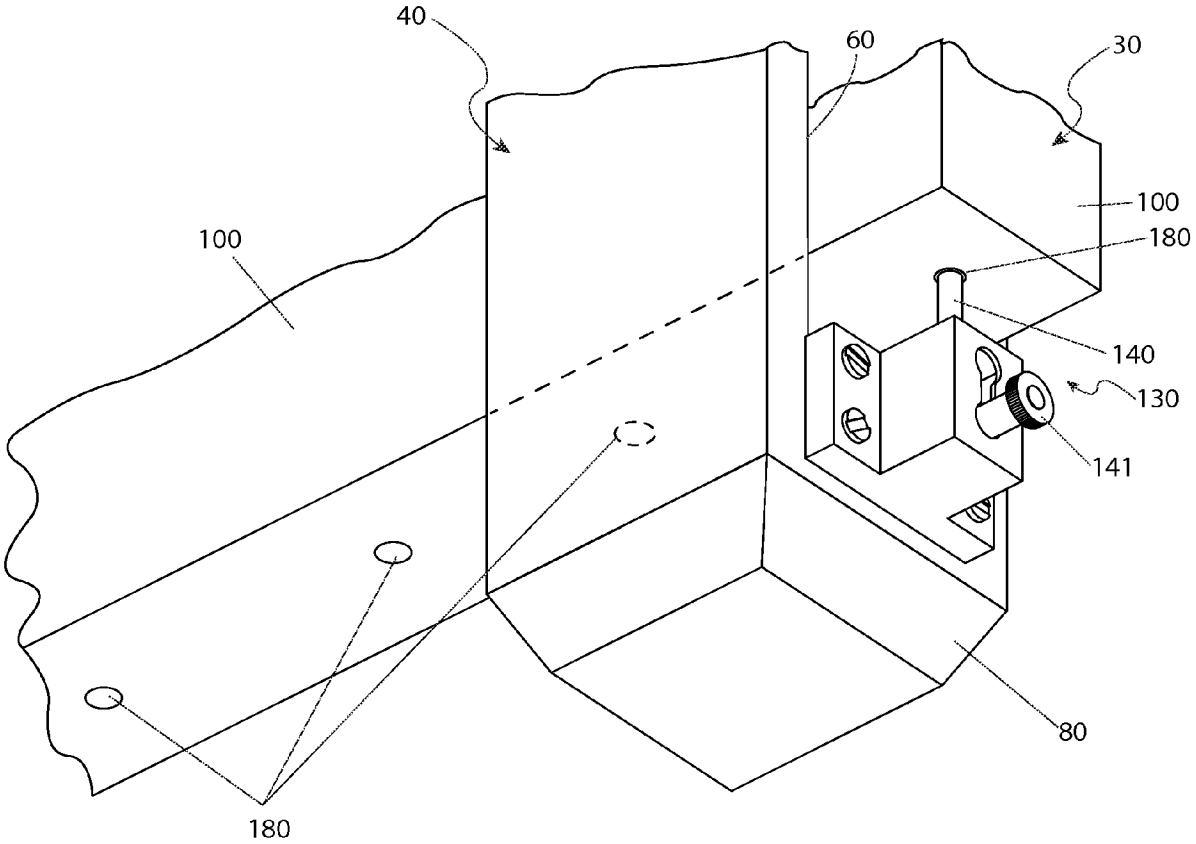

Referring to FIG. 4, the slide column 40 includes a locking mechanism 130 allowing a user to extend and secure the barrier assembly 30 at a desired extended position. In an example embodiment, the locking mechanism 130 is located along a lower rear surface of the slide column 40. The locking mechanism 130 is positioned so as to enable selective engagement of a pin 140 with one (1) of a plurality of circular detents 180 arranged in a row along a bottom surface of the barrier assembly 30.

In another example embodiment, the locking mechanism 130 includes a slide-bolt device having an upwardly protruding pin 140 sized so as to be inserted into a selectively aligned detent 180. The locking mechanism 130 also includes a lock bolt/knob 141 that threadingly engages the pin 140 to provide selective engagement or detachment of the pin 140 in the detent 180. The lock bolt/knob 141 is envisioned to provide a threaded portion enabling the lock bolt/knob 141 to be tightened in position, thereby securing the pin 140 and retaining the barrier assembly 30 at a desired position. However, it is understood that other locations and types of locking mechanisms may be used based upon a particular installation and desired appearance with equal benefit without deviating from the teachings of the present disclosure and as such should not be interpreted as a limiting factor.

Those skilled in the art will recognize that other styles and configurations of the disclosed apparatus 10 can be easily incorporated into the teachings of the present disclosure, and only particular configurations have been shown and described for purposes of clarity and disclosure and not by way of limitation of scope.

The disclosed embodiments of the apparatus 10 can be utilized by the common user in a simple and effortless manner with little or no training. After initial purchase or acquisition of the apparatus 10, it would be installed and utilized as illustrated in FIGS. 1-4.

One (1) embodiment of the disclosed method for installing the apparatus 10 includes the following steps: 1). acquiring a model of the apparatus 10 having a barrier assembly 30 of a desired width and height, as well as a desired external decorative appearance; 2). mounting the slide column 40 to a wall structure 310 of a balcony 300 using the apertures 70 and provided fasteners (e.g., lag screws, wall anchors, or the like); 3). motioning the pin 140 of the locking mechanism 130 to a lowered position using the lock bolt/knob 141; 4). slidably inserting the barrier assembly 30 through the channel 60 of the slide column 40; 5). installing one (1) or both of the handles 120 upon opposing vertical portions of the framework 100 using provided fasteners; and, 6). allowing the barrier assembly 30 be manipulated smoothly in a horizontal direction upon and between the rollers 210.

One (1) embodiment of the disclosed method for utilizing the apparatus 10 to provide additional privacy upon a balcony 300 includes the following steps: 1). lowering the lock bolt/knob 141 of the locking mechanism 130 to release the barrier assembly 30; 2). using one (1) or both handles 120 of the barrier assembly 30 to provide sliding movement of the barrier assembly 30 to a desired extended position which provides a desired level of privacy; 3). lifting the lock bolt/knob 141 to insert the pin 140 within an aligned detent 180; and, 4). rotating and tightening the threaded lock bolt/knob 141 to lock the pin 140 in position.

One (1) embodiment of the disclosed method for installing and utilizing the extension column 50 of the apparatus 10 includes the following steps: 1). mounting the extension column 50 to the railing 305 or other structural member of the balcony 300, for example, using appropriate brackets and fasteners; 2). removing one (1) of the caps 80 from the slide column 40; 3). slidably inserting the inserting feature 90 of the extension column 50 into the open end of the slide column 40; 4). attaching the slide column 40 to the extension column 50 using at least one (1) fastener for additional rigidity, if desired; 5). mounting the slide column 40 to adjacent structures based upon a particular installation scenario using the apertures 70 and provided fasteners; and 6). installing and utilizing the barrier assembly 30 as described above.

Accordingly, the user of the disclosed privacy barrier can benefit from a selective means of increased privacy between adjacent balconies 300.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A privacy barrier apparatus for a balcony, said apparatus comprising:

a slide column configured to be connected to and supported by a vertical structure, said slide column comprising:

a hollow body comprising an open first end and an opposed open second end;

a channel extending through said body, said channel extending from said first end to said second end;

a first roller disposed within said channel at said first end;

a second roller disposed within said channel at said second end; and, a locking mechanism disposed at least one of said first end and said second end;

a barrier assembly slidably connected within said channel of said slide column, said barrier assembly comprising:

an exterior framework comprising a top, a bottom opposite said top, a first side, and a second side opposite said first side defining an interior;

a panel connected within said interior of said framework;

a first handle connected to said first side of said framework; and, a second handle connected to said second side of said framework;

wherein said barrier assembly is linearly movable through said channel to a plurality of linear positions relative to said slide column between a fully retracted position and a fully extended position;

wherein said first roller engages said top of said framework when said barrier assembly is linearly moved within said channel;

wherein said second roller engages said bottom of said framework when said barrier assembly is linearly moved within said channel;

wherein said locking mechanism engages said framework for locking said barrier assembly at a selected linear position of said plurality of linear positions;

wherein said first handle limits linear movement of said barrier assembly to said fully extended position; and, wherein said second handle limits linear movement of said barrier assembly to said fully retracted position.

2. The apparatus of claim 1, wherein said slide column further comprises:

a first cap removably connected to said open first end; and, a second cap removably connected to said open second end.

3. The apparatus of claim 1, wherein said locking mechanism comprises:

a lock knob configured to be moved between a locked position and an unlocked position; and, a pin extending from said lock knob;

wherein at least one of said top and said bottom of said framework comprises a plurality of spaced apart detents; and, wherein said pin engages a selected detent of said plurality of detents when said lock knob is moved to said locked position for locking barrier assembly is said selected linear position.

4. The apparatus of claim 1, further comprising an extension column configured to be connected to a horizontal structure and support said slide column.

5. The apparatus of claim 4, wherein said extension column comprises:

a body comprising a first end and an opposed second end; and, an inserting feature disposed at said second end;

wherein said inserting feature is removably connected within said open first end of said slide column.

6. The apparatus of claim 1, wherein said panel comprises a substantially opaque material.

7. The apparatus of claim 1, wherein said slide column comprises a plurality of fastening apertures configured to receive fasteners for connecting the slide column to said vertical structure.

8. The apparatus of claim 1, wherein said panel comprises a substantially translucent material.

* * * * *